US010765226B2

(12) United States Patent
Lee

(10) Patent No.: US 10,765,226 B2
(45) Date of Patent: Sep. 8, 2020

(54) MATTRESS WITH LONGITUDINALLY ADJUSTABLE VERTICAL RELIEF

(71) Applicant: Jennifer Mirinda Lee, Yuba City, CA (US)

(72) Inventor: Jennifer Mirinda Lee, Yuba City, CA (US)

( * ) Notice: Subject to any disclaimer, the term of this patent is extended or adjusted under 35 U.S.C. 154(b) by 146 days.

(21) Appl. No.: 15/867,436

(22) Filed: Jan. 10, 2018

(65) Prior Publication Data

US 2019/0208920 A1 Jul. 11, 2019

(51) Int. Cl.

| | |
|---|---|
| ***A47C 27/14*** | (2006.01) |
| ***A47C 31/10*** | (2006.01) |
| ***A47C 20/02*** | (2006.01) |
| ***A47C 27/15*** | (2006.01) |

(52) U.S. Cl.

CPC ..... *A47C 27/148* (2013.01); *A47C 20/025* (2013.01); *A47C 27/15* (2013.01); *A47C 31/105* (2013.01)

(58) Field of Classification Search

CPC ..... A47C 20/025; Y10S 5/93; A61G 2200/12; A61G 7/02

See application file for complete search history.

(56) References Cited

U.S. PATENT DOCUMENTS 1,107,683 A * 8/1914 Malarkey ..... A61G 7/02 5/695
1,295,770 A * 2/1919 Lamont ..... A47C 27/001 5/722
1,443,667 A 1/1923 Zachary
2,116,171 A 5/1938 Harris
3,146,469 A * 9/1964 Slade ..... A47C 27/148 5/695
3,276,046 A * 10/1966 Garnet ..... A47G 9/10 5/639
3,378,862 A * 4/1968 Jerald ..... A47C 20/025 5/722
3,639,927 A * 2/1972 Munch ..... A47C 27/146 5/723
3,988,793 A * 11/1976 Abitbol ..... A47C 20/025 601/11
4,021,872 A * 5/1977 Powell ..... A47C 20/025 5/722
4,290,155 A 9/1981 Hanson
4,485,505 A 12/1984 Paul
4,706,313 A * 11/1987 Murphy ..... A47C 27/148 5/722
4,737,999 A * 4/1988 Halverson ..... A47C 20/025 5/710
5,035,015 A * 7/1991 Maietta ..... A47D 13/00 5/630
5,237,712 A * 8/1993 Ramsay ..... A47C 20/025 5/710
5,259,079 A 11/1993 Visser
5,369,824 A * 12/1994 Powell ..... A47C 20/025 5/735

(Continued)

*Primary Examiner* — Peter M. Cuomo
*Assistant Examiner* — Ifeolu A Adeboyejo
(74) *Attorney, Agent, or Firm* — Fish & Richardson P.C.

(57) ABSTRACT

A mattress with a relief portion that is adjustable in both a longitudinal and vertical direction to enable support for a variety of body shapes, and in particular support for a variety of body shapes of expectant mothers.

10 Claims, 6 Drawing Sheets

(56) References Cited

U.S. PATENT DOCUMENTS 5,400,449 A * 3/1995 Satto ..... A47C 20/021 5/631
5,425,147 A 6/1995 Supplee
5,634,255 A 6/1997 Miller, Sr.
5,737,788 A 4/1998 Castellino
5,754,998 A 5/1998 Selton
5,960,496 A * 10/1999 Boyd ..... A47C 27/144 5/722
6,089,668 A 7/2000 Peterson
6,192,538 B1 2/2001 Fogel
6,233,768 B1 * 5/2001 Harding ..... A47C 20/025 5/706
6,516,481 B1 2/2003 Erickson
6,568,015 B1 * 5/2003 Allen ..... A47C 20/026 5/731
6,760,934 B1 7/2004 Leach
6,848,136 B2 * 2/2005 Sonobe ..... A47G 9/10 5/655.9
7,793,371 B1 9/2010 Leach
2002/0020022 A1 * 2/2002 Bernstein ..... A47C 20/025 5/722
2002/0170116 A1 * 11/2002 Borders ..... A61B 6/0457 5/600
2004/0237205 A1 12/2004 McGettigan
2006/0288485 A1 12/2006 Fox
2007/0232172 A1 10/2007 Biermann
2008/0148487 A1 6/2008 Lord
2009/0313760 A1 12/2009 Blake
2010/0281617 A1 11/2010 Brun
2013/0007962 A1 1/2013 Kemper
2013/0081208 A1 4/2013 Dyevich
2016/0106223 A1 4/2016 Lee
2016/0174726 A1 * 6/2016 Smith ..... A47C 27/18 5/735
2018/0078063 A1 * 3/2018 Wallace ..... A47G 9/1045
2018/0263375 A1 * 9/2018 Stewart ..... A47C 20/025

* cited by examiner

MATTRESS WITH LONGITUDINALLY ADJUSTABLE VERTICAL RELIEF

BACKGROUND

Mattresses that have adjustable relief area allow expectant mothers to sleep in various positions with greater comfort than standard mattresses. However, such mattresses typically provide only adjustable relief in a vertical direction from the top surface of the mattress. While mattresses with such relief may benefit some expectant mothers, these mattresses fail to take into account the various body shapes and sizes of expectant mothers. A particular woman's height, weight, and how the woman carries the baby may greatly impact the efficacy of a mattress with abdominal relief, or even render the mattress unusable for the woman. This is because the relief volume may not adequately accommodate the woman's abdomen in a manner that offers adequate relief and comfort during pregnancy. Alternatively, a particular mattress may offer adequate relief during a first or second trimester, but during the later stages of pregnancy the mattress may no longer be able to offer adequate relief.

SUMMARY

This specification relates to a mattress with a vertical relief that is also longitudinally adjustable such that the mattress may accommodate women of various heights, weights and carry positions during pregnancy, and yet still offer necessary support and relief for comfort.

In general, one innovative aspect of the subject matter described in this specification can be embodied in a mattress apparatus that includes a base portion including a top surface, a bottom surface, opposing side surfaces that include a head side surface and a foot side surface, and defining a longitudinal axis from the head side surface to the bottom side surface; a relief volume within a sub-portion of the top surface, the relief volume defined by a relief periphery within the opposing side surfaces of the top portion and side walls extending vertically downward by a vertical distance into the base portion from the relief periphery; a set of central insert elements, wherein each central insert element is shaped such that each central insert element, when inserted into the relief volume, has a first side wall and a second side wall that abuts at least a portion of a first side wall and a second side wall of the relief volume that are opposing each other on opposite sides of the longitudinal axis, and has a third side wall and a fourth side wall that is spaced apart from a third side wall and a fourth side wall of the relief volume to form respective first and second peripheral volumes with the relief volume and that are respectively intersected by the longitudinal axis; for each peripheral volume, a set of peripheral insert elements, wherein each peripheral insert element is shaped such that when inserted into a relief volume, side walls of the peripheral insert element abut the third side wall or the fourth side wall of the central insert element and the third side wall or the fourth side wall of the relief volume; each central insert element and peripheral insert element have respective top and bottom surfaces spaced apart by a respective height that is equal to or less than the vertical distance by which the side walls of the relief volume extend downward; and the central insert elements and the peripheral insert elements may be individually and separately placed within the relief volume so that a plurality of adjusted relief volumes may be formed, wherein each adjusted relief volume is oriented differently from each other adjustable relief volume.

Another innovative aspect of the subject matter described in this specification can be embodied in a mattress apparatus that includes a base portion including a top surface, a bottom surface, opposing side surfaces that include a head side surface and a foot side surface, and defining a longitudinal axis from the head side surface to the bottom side surface; a relief volume within a sub-portion of the top surface, the relief volume defined by a relief periphery within the opposing side surfaces of the top portion and side walls extending vertically downward by a vertical distance into the base portion from the relief periphery; a set of central insert elements, wherein each central insert element is shaped such that each central insert element, when inserted into the relief volume, has a first side wall and a second side wall that abuts at least a portion of a first side wall and a second side wall of the relief volume that are opposing each other on opposite sides of the longitudinal axis, and has a third side wall that is spaced apart from a third side wall of the relief volume to form a first peripheral volume within the relief volume; a set of peripheral insert elements, wherein each peripheral insert element is shaped such that when inserted into the peripheral volume, side walls of the peripheral insert element abut the third side wall the central insert element and the third side wall of the relief volume; each central insert element and peripheral insert element have respective top and bottom surfaces spaced apart by a respective height that is equal to or less than the vertical distance by which the side walls of the relief volume extend downward; and the central insert elements and the peripheral insert elements may be individually and separately placed within the relief volume so that a plurality of adjusted relief volumes may be formed, wherein each adjusted relief volume is oriented differently from each other adjustable relief volume.

The subject matter may realize one or more of the following advantages. The plurality of relief volumes that may be formed enable a single apparatus to accommodate various body shapes. Accordingly, the manufacturing costs required to accommodate multiple different users is reduced. As a person's body shape changes, the relief volume may likewise be adjusted. Accordingly, the apparatus may be used over an entire pregnancy, for example, without the need for additional purchases.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

FIGS. 1-4 are various illustrations of mattress apparatus 100, which includes a base portion 101, central insert elements 150, and peripheral insert elements 160. The mattress apparatus 100 as shown depicts a twin bed configuration; however, the mattress apparatus may also be designed for two persons, e.g., king or queen sized. In these larger sizes, the mattress apparatus 100 may include a relief portion on only one side of the mattress, or, alternatively, on both sides.

Figure 1:
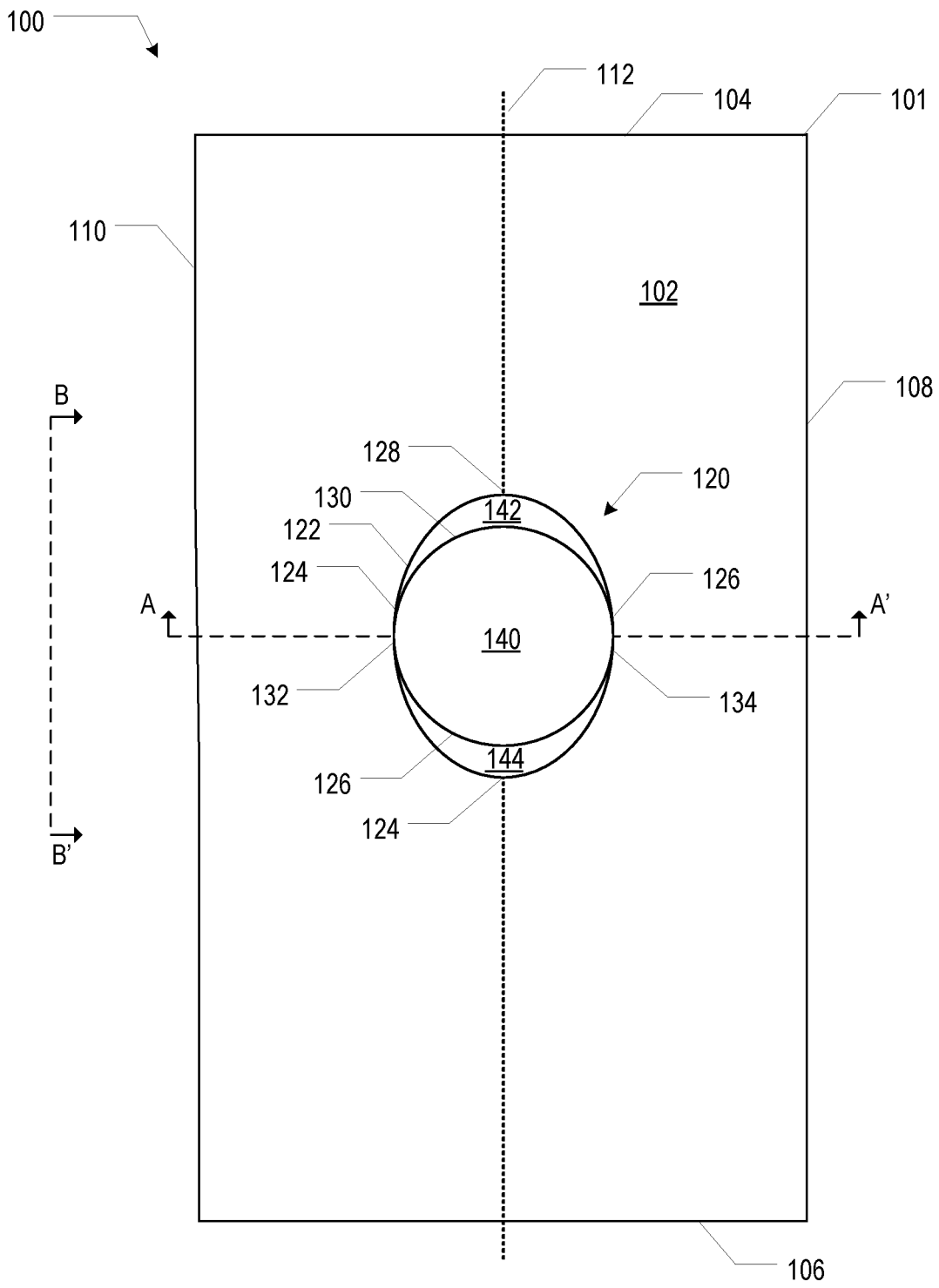
FIG. 1 is a top view of one implementation of a mattress apparatus.
Figure 2:
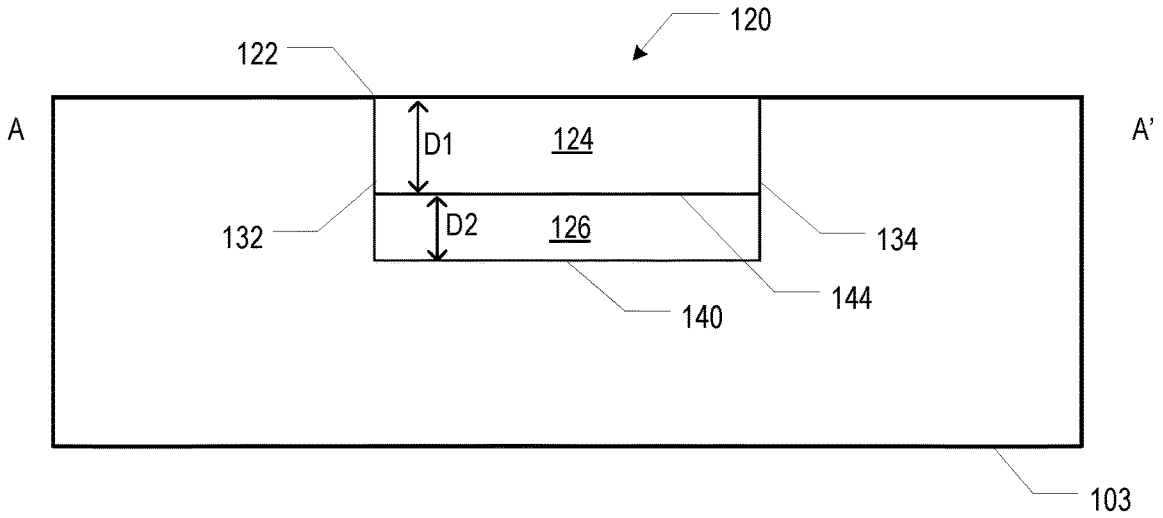
FIG. 2 is a cross-sectional view of the mattress apparatus of FIG. 1.
Figure 3:
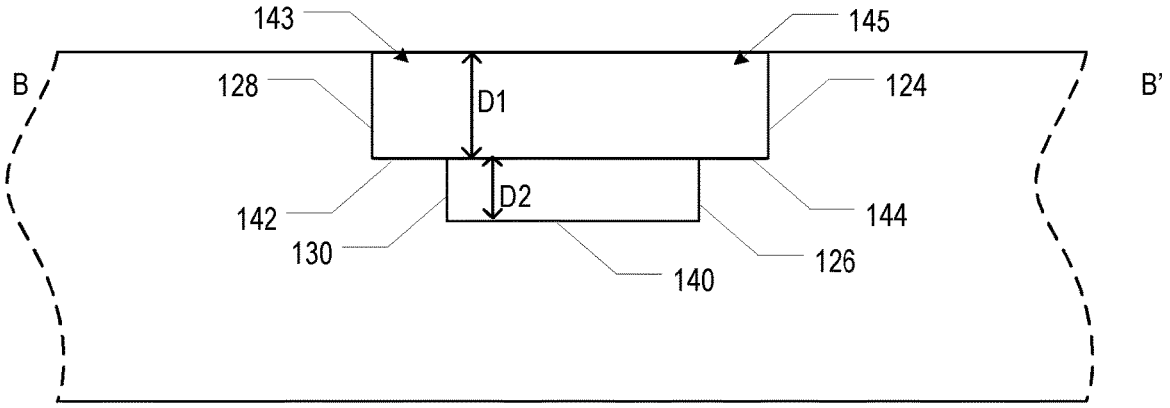
FIG. 3 is another cross-sectional view of the mattress apparatus of FIG. 1.

As shown in FIGS. 1-3, the base portion 101 includes a top surface 102, a bottom surface 103, and opposing side surfaces that include a head side surface 104, a foot side surface 106, right side surface 108 and a left side surface 110. The mattress apparatus 100 defines a longitudinal axis 112 from the head side surface 104 to the foot side surface 106. As shown in FIG. 1, the axis 112 is centrally disposed and in the direction a person will lay when resting on the mattress. For a larger mattress, the axis may be disposed on one side of the mattress such that it is approximately centrally disposed where one of two persons would normally lie in rest.

A relief volume 120 is formed within a sub-portion of the top surface 102. The relief volume 120 is defined by a relief periphery 122 within the opposing side surfaces 104, 106, 108 and 110 of the top portion 101. Side walls 124, 126, 128, 130, 132 and 134 extend vertically downward by a vertical distance into the base portion 101 from the relief periphery 122, thus forming the relief volume 120.

As shown in FIGS. 1-3, the volume has two depths, D1 and D2 . The depth D1 defines a depth to peripheral bottom surfaces 142 and 144, and the sum of the depths D1 and D2 defines a depth to the central bottom surface 140. In an alternate implementation, the entire relief volume 120 may be of the same depth, e.g., D1+D2. As will be described in more detail below, the relief volume 120 is shaped to receive various insert elements 150 and 160 so that a person, particularly an expectant mother, may configure the shape of the relief volume to be one of many possible configurations that each differ in length and/or depth, thereby allowing the person to adjust the mattress to provide optimum support for the person's particular body shape.

The mattress apparatus 100 includes a set of central insert elements 150. Each central insert element 150 is shaped such that each central insert element 150, when inserted into the relief volume 120, has a first side wall 152 and a second side wall 154 that abuts at least a portion of a first side wall 132 and a second side wall 134 of the relief volume 120. The first side wall 132 and a second side wall 134 are opposing each other on opposite sides of the longitudinal axis 112 as shown in FIG. 1.

The central insert element 150, which in this example is circular, has a third side wall 156 and a fourth side wall 158 (in this case, arcuate regions of the cylindrical sides of the circularly shaped insert element). When inserted into the relief volume 120 of the base portion 101, the third side wall 156 and a fourth side wall 158 are spaced apart from a third side wall 124 and a fourth side wall 128 of the relief volume 120 to form respective first and second peripheral volumes 145 and 143 within the relief volume 120. The peripheral relief volumes 143 and 145 are respectively intersected by the longitudinal axis 112 and are respectively located above the peripheral bottom surfaces 142 and 144.

For each peripheral volume 143 and 145, the mattress apparatus 100 includes a set of peripheral insert elements 160. Each peripheral insert element 160 is shaped such that when inserted into the relief volume 120 (and in particular, into a peripheral volume of the relief volume), the side wall 164 of the peripheral insert element 160 abut the third side wall 156 or the fourth side wall 158 of the central insert element 150, and the side wall 162 abuts the third side wall 124 or the fourth side wall 128 of the relief volume 120.

Each central insert element 150 and peripheral insert element 160 have respective top surfaces 159 and 169 and bottom surfaces 158 and 168 spaced apart by a respective height (or vertical thickness of the insert element) that is equal to or less than the vertical distance by which the side walls of the relief volume 120 extend downward. For example, assume that the distance D2 is one-half the distance of D1, and the each insert element 150 and 160 has a respective height of D2. The central insert elements 150 and the peripheral insert elements 160 may thus be individually and separately placed within the relief volume 120 so that multiple adjusted relief volumes 120 may be formed, where each adjusted relief volume 120 is oriented differently from each other adjustable relief volume 120.

Figure 5A:
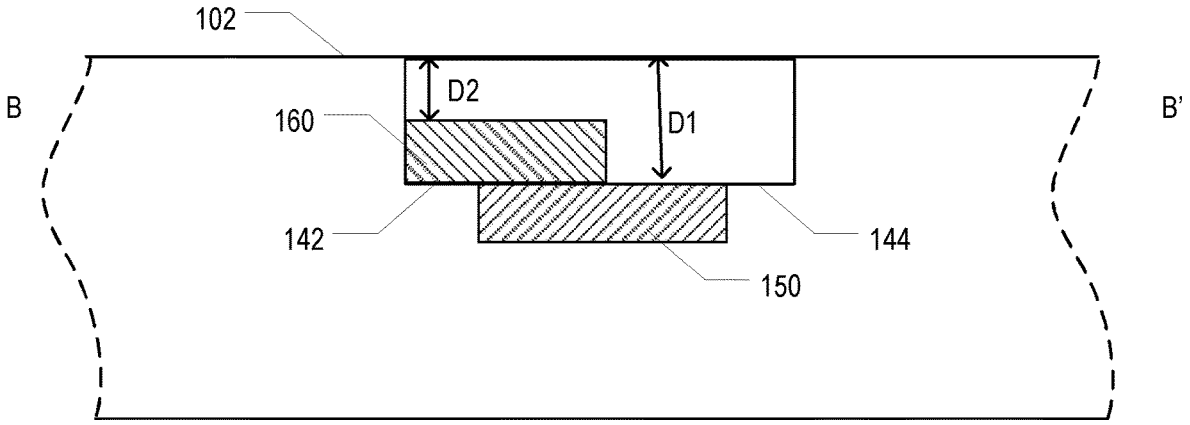
FIGS. 5A and 5B illustrate an example adjusted relief volume.
Figure 5B:
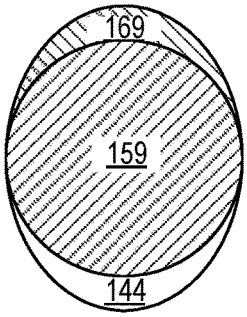

One example of an adjusted relief volume is shown in FIGS. 5A and 5B, which illustrate a cross-sectional view and a top view of an adjusted relief volume 120. In this example, a single central insert element 150 and a single peripheral insert element 160 are inserted into the relief volume. This results in two support surfaces—the support surface 160, which is a distance D2 from the top surface 102, and the combination support surface formed by flush surfaces 169 and 144, which is a distance D1 (or 2* D2) from the top surface 102. By adding or removing insert elements 150 and 160, the relief volume may be both longitudinally and vertically adjusted to support different body shapes.

Note that the side wall 164 of the peripheral insert element 160 abuts a side wall of a central insert element 150 when the central insert element in similar vertical disposition with the peripheral insert element 160. Otherwise, the side wall 164 is exposed. For example, assume that only enough central insert elements 150 (e.g., one or more) are inserted into the relief volume 120 such that a top surface 159 of a top stacked central insert element 150 is flush with the peripheral bottom surfaces 142 and 144 (e.g., as shown in FIGS. 5A and 5B). Then the peripheral insert element 160 is inserted such that it sits atop the peripheral bottom surface 142, and the side wall 162 abuts the side wall 128. The side wall 164 will then be exposed, as shown in FIG. 5B.

Figure 4:
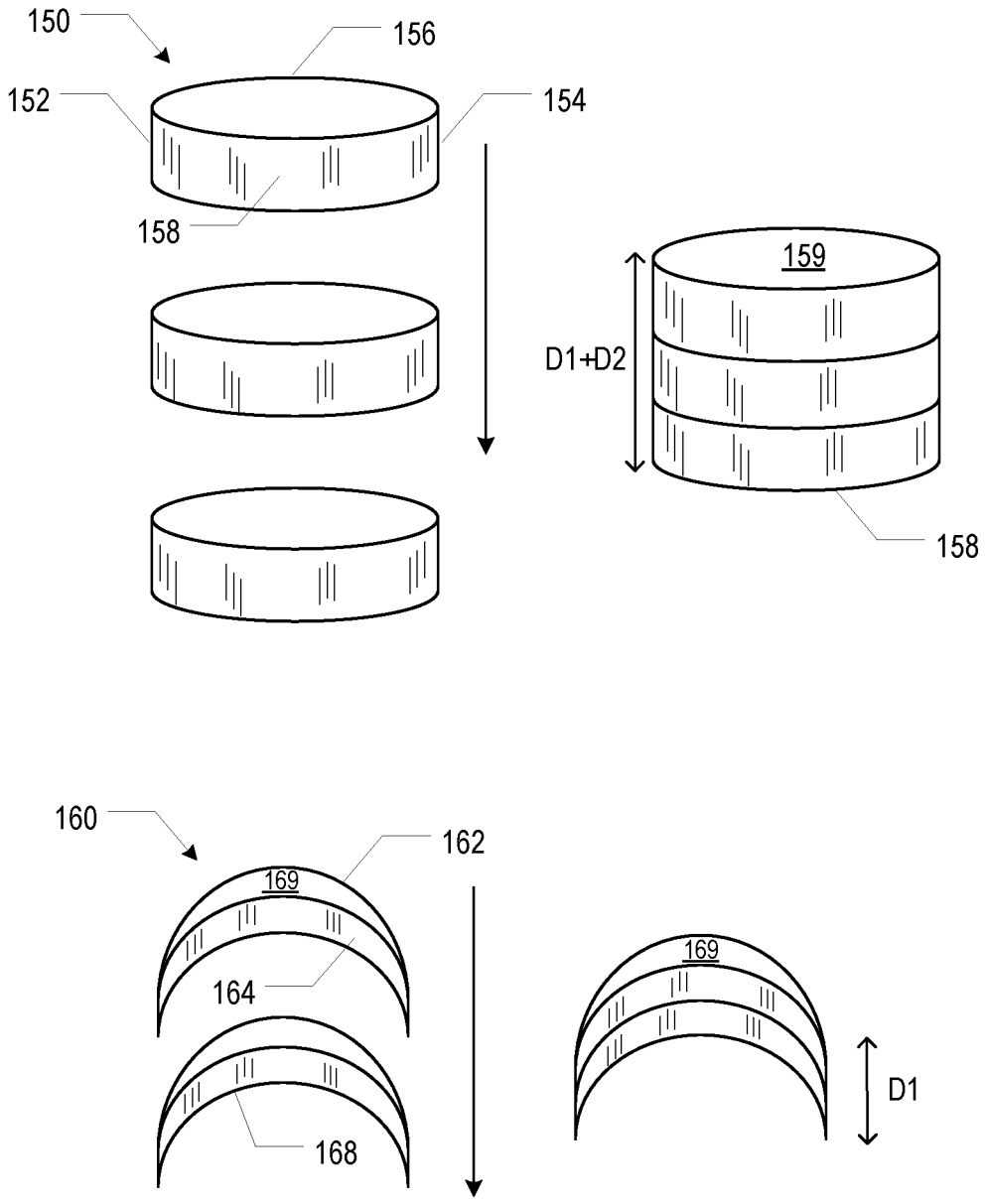
FIG. 4 are perspective views of the central insert elements and the peripheral insert elements.

As illustrated in FIG. 4, the set of central insert elements 150 include two or more central insert elements 150 that are stackable on each other. Each have a respective height such that when the entire set of central insert elements 150 are vertically stacked within the relief volume, a top surface 159 of a top stacked central insert element 150 is flush with the top surface 102 of the base portion 101. Otherwise, when a proper subset of the set of central insert elements 150 are vertically stacked within the relief volume, a top surface 159 of a top stacked central insert element 150 is below the top surface 102 of the base portion 101, as illustrated in FIGS. 5A and 5B.

Likewise, each set of peripheral insert elements 160 may include one or more peripheral insert elements 160. In the case in which two or more peripheral insert elements 160 are included in a set, the elements 160 are stackable on each other, and that each has a respective height such that when the entire set of peripheral insert elements 160 are vertically stacked within the relief volume, a top surface 169 of a top stacked peripheral insert element 160 is flush with the top surface 102 of the base portion 101. Conversely, when a proper subset of the set of peripheral insert elements 160 are vertically stacked within the relief volume, a top surface 169 of a top stacked peripheral insert element 160 is below the top surface 102 of the base portion 101. Again, this latter configuration is shown in FIGS. 5A and 5B, where the top surface 169 is a distance D2 below the top surface 102.

In the example implementation shown in FIGS. 1-5B, the first side wall 132 and the second side wall 134 of the relief volume that abut at least the first side 152 wall and the second side wall 154 of the central insert element 150 extend downward a first vertical distance D1 +D2, and the third side wall 124 and the fourth side wall 128 of the relief volume that abut the side walls of the peripheral insert elements 160 extend downward a second vertical distance D1 that is less than the first vertical distance D1+D2, which results in the peripheral bottom surfaces 142 and 144. The relief volume 120 is thus further defined by peripheral bottom surfaces disposed by the second vertical distance from the top surface 102 of the base portion 101 and the central bottom surface 140 that is below the peripheral bottom surfaces 142 and 144 and disposed the first vertical distance D1 +D2 from the base portion 101.

Figure 6:
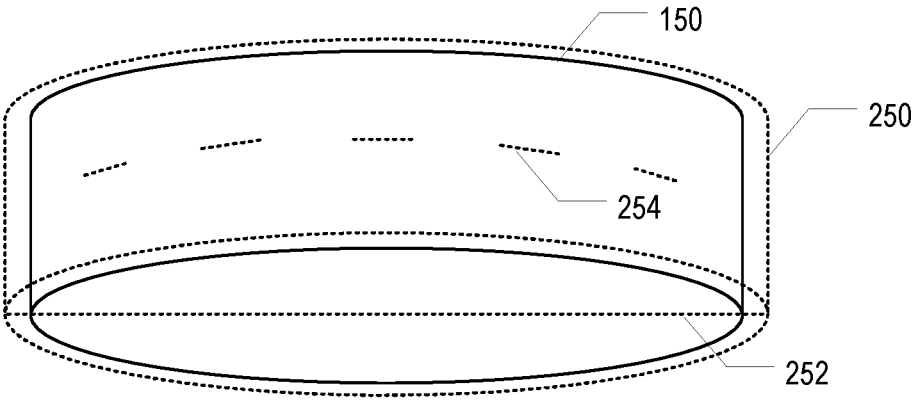
FIG. 6 is an illustration of a covering for a central insert element.
Figure 7:
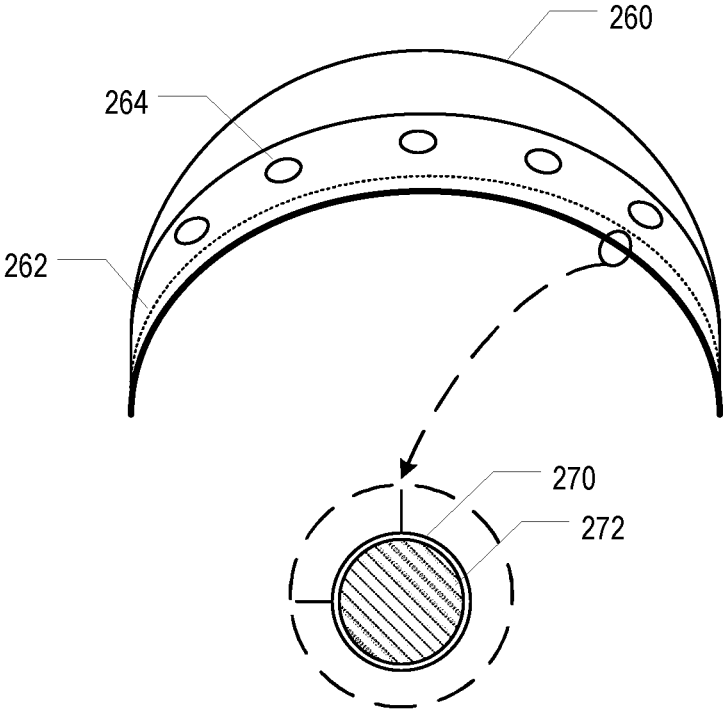
FIG. 7 is an illustration of a covering for a peripheral insert element.

FIGS. 6 and 7 are illustrations of coverings 250 and 260 for a central insert element 150 and a peripheral element 160, respectively. The covering 250 is shown in phantom and its size is slightly exaggerated relative to the central insert element 150 for illustrative purposes. The covering 250 includes a closure 252 on the bottom that may be opened to insert or remove the central insert element 150. Any appropriate closure mechanism may be used, such as buttons, a zipper, or hook and loop fasteners, and the like. Alternatively, the closure may simply be overlapping fabric.

The covering 260, which is not shown in phantom, also includes a closure 262 on the side and that may be opened to insert or remove the peripheral insert element 160. Although shown on the interior side, the closure may instead be on the bottom or on the other side.

In some implementations, the coverings 250 and 260 include fasteners that enable the insert elements to be affixed to each other. For example, as shown in FIGS. 6 and 7, the covering 250 includes button slots 254 and the covering 260 includes buttons. In an alternate implementation, the covering 250 may not include fasteners, the covering 260 may include buttons on the opposite side, and a mattress covering may include buttonholes to receive the buttons 264 of the covering 260. This has the added advantage of not exposing the person to the buttons when the inserts are used. Other fastening devices may also be used, and fastening devices may be located on any of the surfaces of the coverings 250 and 260.

Finally, in some implementations, the covering 260 may include a fabric loop 270 in which may be inserted a stiffener, such as a pre-shaped plastic stiffener 272, which can assist maintaining the crescent shape of peripheral insert element 160. The stiffener 272 may be slipped out of the loop 270 when the covering 250 is to be cleaned.

In some implementations, wherein the base portion 101 and the insert elements are formed out of memory foam. Any appropriate memory foam density may be used, e.g., 3 pound foam, 4 pound foam, depending on the firmness and density desired. In some implementations, the base portion may be made of a foam having a first density, and the inserts may be made of a foam having a second density different from the first density.

Figure 8:
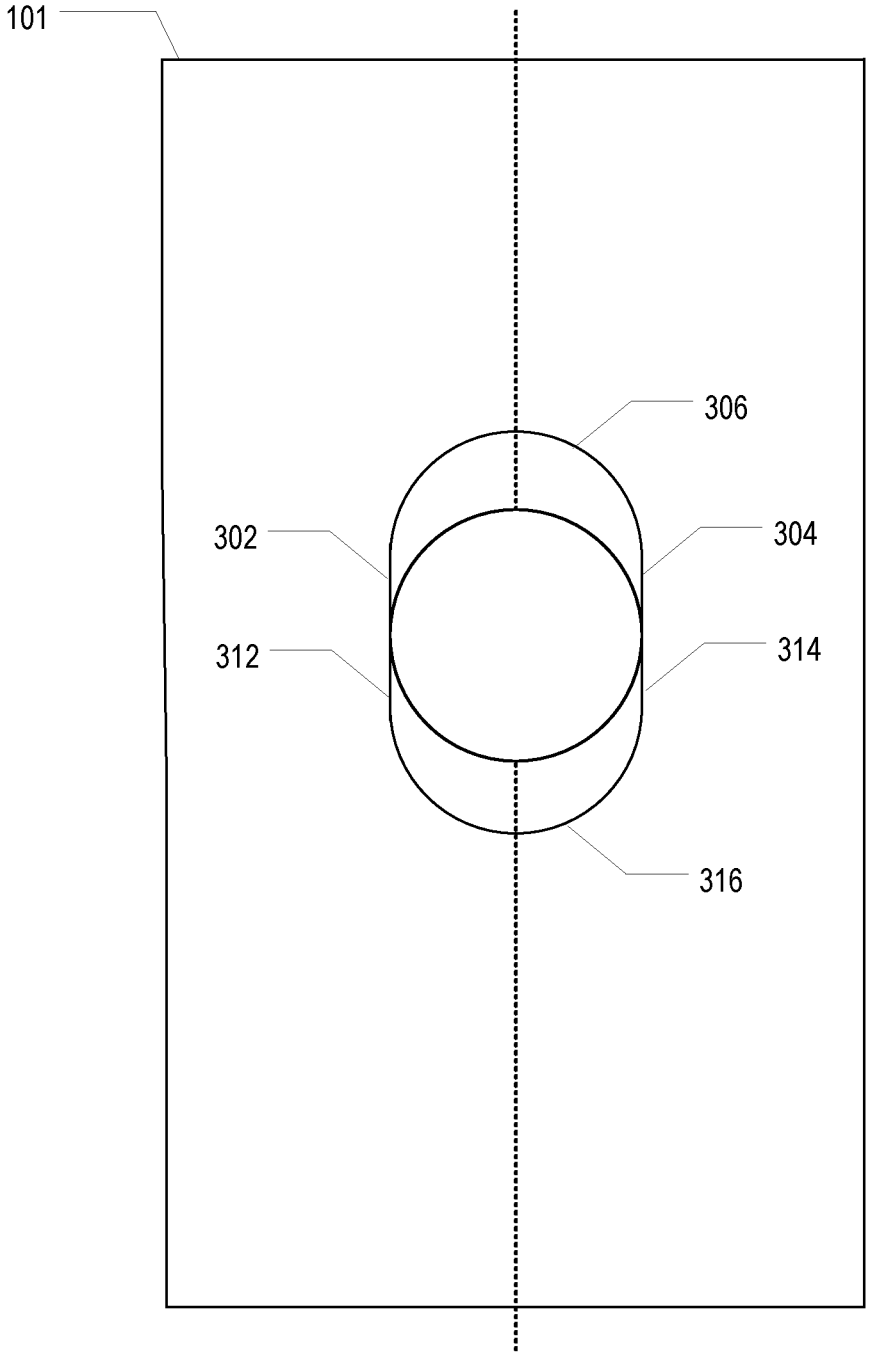
FIG. 8 is an illustration of another implementation of a mattress apparatus.

Other shapes for insert elements may also be used. For example, in FIG. 8, the a circular central insert element and elongated crescent peripheral insert elements may be used, as indicated by the elongated side walls 302 and 304 in connection with the peripheral wall 306, and elongated side walls 312 and 314 in connection with the peripheral wall 316. Additionally, the central inserts need not be circular in shape; they instead may be oblong, or even rectangular. Likewise, different periphery shapes may also be used.

While the insert elements 150 and 160 are described as being of equal heights, they may instead each be of different heights. Moreover, while the example implementation illustrates three central inserts and two peripheral inserts, more or fewer inserts could be used. For example, in some implementations, inserts may be stacked up to four, five or even six deep before having a top-stacked element surface flush with the top surface of the base portion.

Finally, in some implementations, only one set of peripheral insert elements may be used. For example, with reference to FIG. 1, the relief volume may be shaped such that the bottom peripheral volume 145 does not exist, and thus only one peripheral volume (e.g., volume 143) is formed.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A mattress apparatus, comprising:

a base portion including a top surface, a bottom surface, opposing side surfaces that include a head side surface and a foot side surface, and defining a longitudinal axis from the head side surface to the foot side surface;

a relief volume within a sub-portion of the top surface, the relief volume defined by a relief periphery within the opposing side surfaces of the top portion and side walls extending vertically downward by a vertical distance into the base portion from the relief periphery, wherein the relief periphery defines a rounded shape;

a set of two or more central insert elements, wherein each central insert element is shaped such that each central insert element, when inserted into the relief volume, has a first side wall and a second side wall that abuts at least a portion of a first side wall and a second side wall of the relief volume that are opposing each other on opposite sides of the longitudinal axis, and has a third side wall and a fourth side wall that is spaced apart from a third side wall and a fourth side wall of the relief volume to form respective first and second peripheral volumes within the relief volume and that are respectively intersected by the longitudinal axis, wherein each insert element has a rounded periphery formed by the first, second, third and fourth sidewalls of the central insert element, and the first peripheral volume and the second peripheral volume are on opposite sides of insert element;

for each first and second peripheral volume, a set of one or more peripheral insert elements, wherein each peripheral insert element is shaped such that when inserted into the relief volume, side walls of the peripheral insert element abut the third side wall or the fourth side wall of a central insert element that is in similar vertical disposition with the peripheral insert element, and abut the third side wall or the fourth side wall of the relief volume, wherein each peripheral insert element is crescent shaped;

each central insert element has respective top and bottom surfaces spaced apart by a respective height that is less than the vertical distance by which the side walls of the relief volume into which the central insert elements are received extend downward;

each peripheral insert element has respective top and bottom surfaces spaced apart by a respective height that is equal to or less than the vertical distance by which the side walls of the relief volume into which the peripheral insert element is received extend downward;

the central insert elements and the peripheral insert elements may be individually and separately placed within the relief volume so that a plurality of adjusted relief volumes may be formed, wherein each adjusted relief volume is oriented differently from each other adjustable relief volume; and the relief periphery of the relief volume matches the periphery of the central insert element abutted on opposite sides by the peripheral insert elements.

2. The apparatus of claim 1, wherein two or more central insert elements are stackable on each other and that each have a respective height such that when the entire set of the two or more central insert elements are vertically stacked within the relief volume, a top surface of a top stacked central insert element is flush with the top surface of the base portion, and when a proper subset of the set of central insert elements are vertically stacked within the relief volume, a top surface of a top stacked central insert element is below the top surface of the base portion.

3. The apparatus of claim 2, wherein each set of peripheral insert elements include two or more peripheral insert elements that are stackable on each other and that each have a respective height such that when the entire set of peripheral insert elements are vertically stacked within the peripheral relief volume, a top surface of a top stacked peripheral insert element is flush with the top surface of the base portion, and when a proper subset of the set of peripheral insert elements are vertically stacked within the relief volume, a top surface of a top stacked peripheral insert element is below the top surface of the base portion.

4. The apparatus of claim 1, wherein:

the first side wall and the second side wall of the relief volume that abut at least the first side wall and the second side wall of the central insert element extend downward a first vertical distance equal to the vertical distance, and the third side wall and the fourth side walls of the relief volume that abut the side walls of the peripheral insert elements extend downward a second vertical distance that is less than the first vertical distance; and the relief volume is further defined by peripheral bottom surfaces that are flat surfaces disposed the second vertical distance from the top surface of the base portion and a central bottom surface that is a flat surface and that is below the peripheral bottom surfaces and disposed the first vertical distance from the base portion.

5. The apparatus of claim 4, wherein:

the two or more central insert elements are stackable on each other and each have a respective height such that when the entire set of central insert elements are vertically stacked within the relief volume, a top surface of a top stacked central insert element is flush with the top surface of the base portion, and when a proper subset of the set of central insert elements are vertically stacked within the relief volume, a top surface of a top stacked central insert element is below the top surface of the base portion; and each set of peripheral insert elements include one or more peripheral insert elements that each have a respective height such that when the entire set of peripheral insert elements are placed within the peripheral relief volume, a top surface of a peripheral insert element is flush with the top surface of the base portion, and when no peripheral element is placed within the relief volume, the peripheral bottom surfaces of the relief volume is exposed.

6. The apparatus of claim 1, wherein the base portion comprises memory foam.

7. The apparatus of claim 1, wherein the central insert element and the peripheral insert elements comprise memory foam.

8. The apparatus of claim 1, wherein the relief volume is centrally disposed within the base portion.

9. The apparatus of claim 1, wherein:

the central insert elements are circular shaped.

10. A mattress apparatus, comprising:

a base portion including a top surface, a bottom surface, opposing side surfaces that include a head side surface and a foot side surface, and defining a longitudinal axis from the head side surface to the foot side surface;

a relief volume within a sub-portion of the top surface, the relief volume defined by a relief periphery within the opposing side surfaces of the top portion and side walls extending vertically downward by a vertical distance into the base portion from the relief periphery;

a set of two or more central insert elements, a first set of one or more peripheral insert elements, and a second set of one or more peripheral insert elements, wherein:

each central insert element has a rounded periphery such that each central insert element, when inserted into the relief volume, fills a central portion of the relief volume and is spaced apart from opposite side walls of the relief volume that are respectively intersected by the longitudinal axis to thereby define a respective first peripheral volume between a first portion of the relief periphery and a first portion of the rounded periphery of the central insert element, and a respective second peripheral volume between a second portion of the relief periphery and a second portion of the rounded periphery of the central insert element;

each peripheral insert element in the first set of one or more peripheral insert elements has a first periphery portion that is rounded to match the first portion of the relief periphery, and has a second periphery portion that is rounded to match the first portion of the rounded periphery of the central insert element, and that when inserted into the first peripheral volume, fills at least a portion of the first peripheral volume;

each peripheral insert element in the second set of one or more peripheral insert elements has a first periphery portion that is rounded to match the second portion of the relief periphery, and has a second periphery portion that is rounded to match the second portion of the rounded periphery of the central insert element, and that when inserted into the second peripheral volume, fills at least a portion of the second peripheral volume;

each central insert element has respective top and bottom surfaces spaced apart by a respective height that is less than the vertical distance by which the side walls of the relief volume into which the central insert elements are received extend downward;

each peripheral insert element has respective top and bottom surfaces spaced apart by a respective height that is equal to or less than the vertical distance by which side walls of the peripheral volume into which the peripheral insert element is received extend downward;

the central insert elements and the peripheral insert elements may be individually and separately placed within the relief volume so that a plurality of adjusted relief volumes may be formed, wherein each adjusted relief volume is oriented differently from each other adjustable relief volume.

* * * * *